US007743741B2

(12) United States Patent
Matsuda

(10) Patent No.: US 7,743,741 B2
(45) Date of Patent: Jun. 29, 2010

(54) FUEL INJECTION ENGINE AND MOTORCYCLE COMPRISING FUEL INJECTION ENGINE

(75) Inventor: Yoshimoto Matsuda, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 237 days.

(21) Appl. No.: 11/586,334

(22) Filed: Oct. 24, 2006

(65) Prior Publication Data

US 2007/0095305 A1 May 3, 2007

(30) Foreign Application Priority Data

Oct. 24, 2005 (JP) ..... 2005-307992

(51) Int. Cl.
*F02F 1/36* (2006.01)
*F02F 1/40* (2006.01)
*F02F 1/42* (2006.01)

(52) U.S. Cl. ..... 123/41.82 R; 123/472; 123/445

(58) Field of Classification Search ..... 123/472, 123/41.22, 41.82 R, 41.72, 193.5, 445, 470
See application file for complete search history.

(56) References Cited

U.S. PATENT DOCUMENTS 1,610,000 A * 12/1926 Fay ..... 123/545
2,710,602 A * 6/1955 Maybach ..... 123/41.76
3,769,948 A * 11/1973 Feichtinger et al. ..... 123/41.31
4,759,317 A * 7/1988 Ampferer ..... 123/41.74
4,972,807 A * 11/1990 Morishita ..... 123/41.82 R
5,379,729 A * 1/1995 Yonezwa et al. ..... 123/41.82 R
5,758,623 A * 6/1998 Nitta et al. ..... 123/470
6,481,392 B1 * 11/2002 Etemad ..... 123/41.74
6,520,126 B2 * 2/2003 Kawamoto ..... 123/41.82 R
6,981,473 B2 * 1/2006 Gunji et al. ..... 123/41.82 R
7,101,238 B2 * 9/2006 Aichinger et al. ..... 440/88 A
2004/0139933 A1 * 7/2004 Obermayer et al. ... 123/41.82 R

FOREIGN PATENT DOCUMENTS

JP 2000-320434 11/2000

* cited by examiner

*Primary Examiner*—Stephen K Cronin
*Assistant Examiner*—J. Page Hufty
(74) *Attorney, Agent, or Firm*—Alleman Hall McCoy Russell & Tuttle LLP

(57) ABSTRACT

An air fuel injection engine including an air-intake passage configured to guide air taken in from outside to a combustion chamber formed by a cylinder block and a cylinder head, a fuel injector configured to inject fuel to an interior of the air-intake passage, and a water jacket through which cooling water flows to cool the air-intake passage. As viewed in a plane crossing an air flow direction in the air-intake passage and passing through a predetermined region of an inner wall of the air-intake passage, the predetermined region including a crossing point at which a fuel injection center line of the fuel injected from the fuel injector crosses the inner wall of the air-intake passage, the water jacket is configured to extend away from the crossing point along a circumferential direction of the air-intake passage, from a region near the predetermined region.

5 Claims, 4 Drawing Sheets

FUEL INJECTION ENGINE AND MOTORCYCLE COMPRISING FUEL INJECTION ENGINE

TECHNICAL FIELD

The present invention generally relates to a fuel injection engine. More particularly, the present invention relates to a structure for suppressing cooling of a wall portion of an air-intake passage to which an injected fuel adheres, and a motorcycle comprising the fuel injection engine.

BACKGROUND OF THE INVENTION

In a fuel injection engine mounted in a motorcycle, an air-intake passage extends from an air cleaner box to a combustion chamber formed in the interior of a cylinder. The air-intake passage typically includes an intake port that is formed in the interior of a cylinder head and allows the interior of the combustion chamber and the outside of the cylinder head to communicate with each other, and an air-intake pipe connected to the intake port and extending outside the cylinder head. A butterfly valve is disposed in the air-intake pipe or at a location between the air-intake pipe and the air cleaner box. A fuel injector is disposed downstream of the butterfly valve in an air flow direction (see Japanese Laid-Open Patent Application Publication No. 2000-320434).

In the above described fuel injection engine, air is supplied from the air cleaner box to the combustion chamber through the air-intake passage with an amount according to an opening degree of the butterfly valve which is moved in response to a rider's operation to rotate a throttle grip of the motorcycle. The fuel injector injects a fuel into the air-intake passage in the form of a mist flow at a time in accordance with an electric signal sent from a controller independently equipped. A large part of the injected fuel is delivered together with the air flowing in the air-intake passage and is supplied to the interior of the combustion chamber from the intake port of the cylinder head.

Some of the fuel injected from the fuel injector is not delivered together with the air but collides against and adheres to an inner wall of the air-intake passage. In many cases, the fuel adheres to an inner wall of the intake port of the cylinder head, though the location varies depending on the placement or orientation of the fuel injector. The fuel adhering to the inner wall is later vaporized into a gas, which is delivered into the combustion chamber together with the air flowing from the air cleaner box through the air-intake passage.

A water jacket is formed in the cylinder head to cool portions of the cylinder head by cooling water flowing therein, during running of the engine. For example, the cooling water flowing in the water jacket formed around the intake port cools a wall portion forming the intake port, thereby cooling the air supplied to the combustion chamber. This increases filling efficiency of the air.

However, if the entire wall portion around the air-intake port is cooled, then vaporization of the fuel adhering to the inner wall of the intake port is impeded. As a result, fuel efficiency of the fuel injection engine is not improved. Such a problem arises in general fuel injection engines as well as in a fuel injection engine mounted in a motorcycle.

SUMMARY OF THE INVENTION

The present invention addresses the above described conditions, and an object of the present invention is to provide a fuel injection engine that is capable of facilitating vaporization of a fuel that is injected from a fuel injector and adheres to an inner wall of an intake port, thereby improving fuel efficiency and effectively cooling air that is taken in from outside and is supplied to a combustion chamber, and a motorcycle comprising the fuel injection engine.

According to one aspect of the present invention, there is provided a fuel injection engine comprising an air-intake passage configured to guide air taken in from outside to a combustion chamber formed by a cylinder block and a cylinder head; a fuel injector configured to inject fuel to an interior of the air-intake passage; and a water jacket through which cooling water flows to cool the air-intake passage; wherein as viewed in a plane crossing an air flow direction in the air-intake passage and passing through a predetermined region of an inner wall of the air-intake passage, the predetermined region including a crossing point at which a fuel injection center line of the fuel injected from the fuel injector crosses the inner wall of the air-intake passage, the water jacket is configured to extend away from the crossing point along a circumferential direction of the air-intake passage, from a region near the predetermined region.

In such a configuration, cooling of the predetermined region of the wall portion of the air-intake passage to which the fuel injected from the fuel injector is likely to adhere can be suppressed, and thus the fuel adhering onto the inner wall of the air-intake passage can be vaporized in a relatively short time. In addition, since the water jacket extends from the region near lateral positions of the predetermined region in the circumferential direction of the air-intake passage, the inner wall of the air-intake passage except for the predetermined region can be effectively cooled by the cooling water flowing in the water jacket.

The water jacket may extend from a region near one lateral end position of the predetermined region to a region near an opposite lateral end position of the predetermined region as viewed in the plane. Thereby, the intake port can be effectively cooled.

The water jacket may extend to a region beyond a straight line connecting lateral ends of the predetermined region of the inner wall of the air-intake passage. In such a configuration, cooling of the predetermined region of the air-intake passage can be suppressed while effectively cooling a region of the air-intake passage other than the predetermined region.

The fuel injection engine may further comprise a valve configured to open and close an opening of the air-intake passage that is located downstream in the air flow direction, the valve having a valve stem. The crossing point may be located downstream of a location where the valve stem penetrates through an inner wall of an intake port provided in the cylinder head and forming a part of the air-intake passage.

The fuel injector may be attached to a wall portion of the air-intake passage, and the engine may further comprise a butterfly valve that is mounted upstream of the fuel injector in the air flow direction and is configured to be pivotable in the air flow direction to control an amount of the air flowing in the air-intake passage, the butterfly valve being configured to open the air-intake passage in such a manner that a portion of the butterfly valve which is closer to the fuel injector than a pivot shaft thereof is pivoted in the air flow direction.

In such a configuration, since the fuel injected from the fuel injector is delivered together with substantially layered air flow in the air-intake passage through a gap between the butterfly valve and the inner wall of the air-intake passage, the fuel does not spread or scatter in a wide angle range, and thus the predetermined region is made smaller. This allows the water jacket to be easily formed to extend in a wider range. As a result, vaporization of the fuel and cooling of the air can be effectively carried out.

According to another aspect of the present invention, there is provided a motorcycle comprising a fuel injection engine including an air-intake passage configured to guide air taken in from outside to a combustion chamber formed by a cylinder block and a cylinder head; a fuel injector configured to inject fuel to an interior of the air-intake passage; and a water jacket through which cooling water flows to cool the air-intake passage; wherein as viewed in a plane crossing an air flow direction in the air-intake passage and passing through a predetermined region of an inner wall of the air-intake passage, the predetermined region including a crossing point at which a fuel injection center line of the fuel injected from the fuel injector crosses the inner wall of the air-intake passage, the water jacket is configured to extend away from the crossing point along a circumferential direction of the air-intake passage, from a region near the predetermined region.

In such a configuration, the motorcycle can be equipped with the fuel injection engine in which the fuel injected from the fuel injector and adhering to the inner wall of the intake port is vaporized in a relatively short time and is delivered to the combustion chamber together with the air flow, thereby increasing fuel efficiency.

The above and further objects and features of the invention will more fully be apparent from the following detailed description with accompanying drawings.

DETAILED DESCRIPTION OF THE PREFERRED EMBODIMENTS

Hereinafter, a fuel injection engine and a motorcycle including the fuel injection engine according to an embodiment of the present invention will be described with reference to the accompanying drawings. The directions described herein refer to directions from the perspective of a rider mounting the motorcycle, except for a case specifically illustrated.

Figure 1:
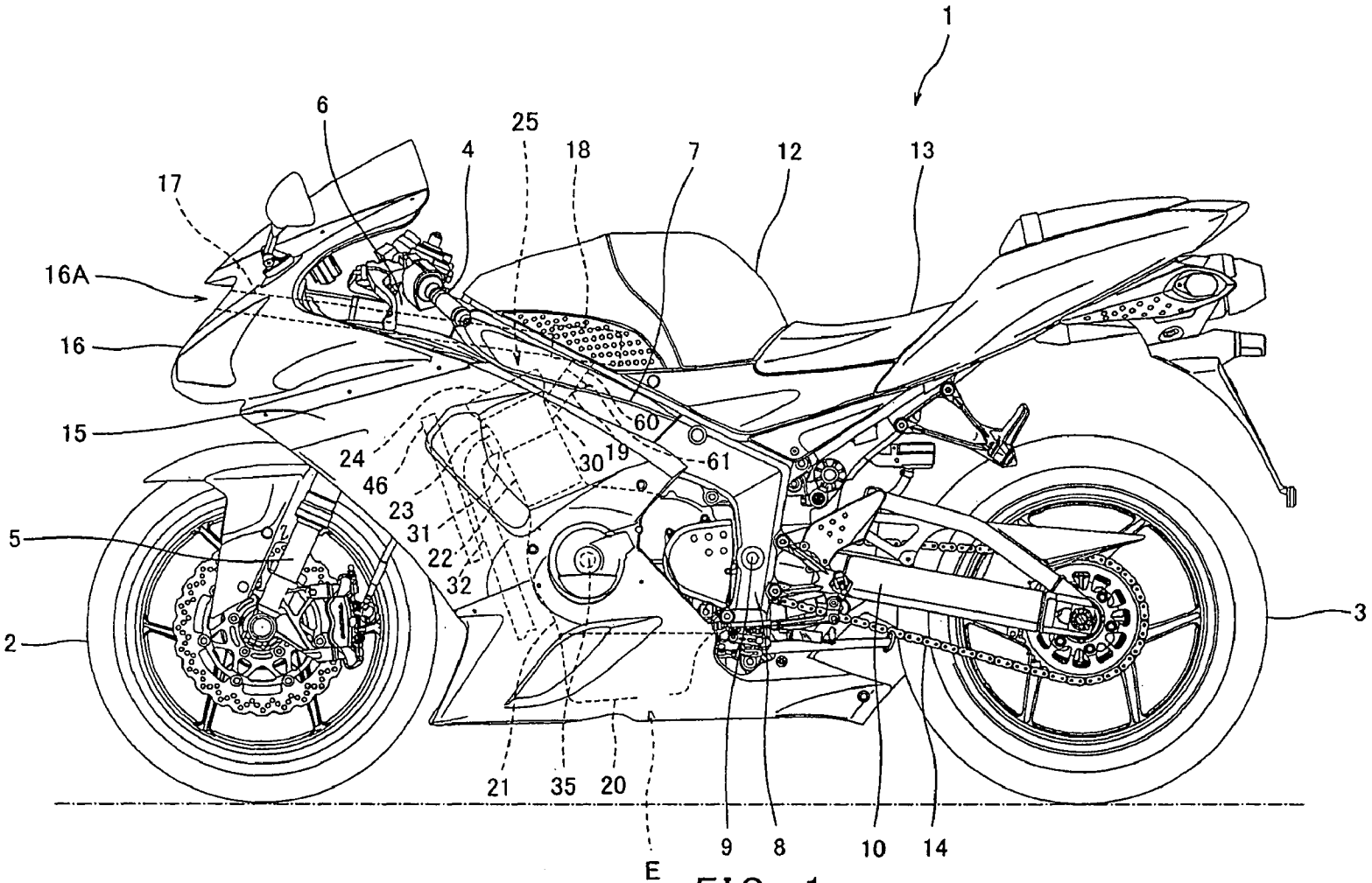
FIG. 1 is a left side view of a fuel injection engine and a motorcycle including the fuel injection engine according to an embodiment of the present invention.

Turning now to FIG. 1, the motorcycle 1 includes a front wheel 2 and a rear wheel 3. The front wheel 2 is rotatably mounted to a lower region of a front fork 5 extending substantially vertically. A bar-type steering handle 4 extending in a lateral direction of the motorcycle 1 is attached to an upper region of the front fork 5 by a steering shaft (nor shown). The steering shaft is rotatably supported by a head pipe 6 disposed at a front portion of a vehicle body frame. When the rider rotates the steering handle 4 clockwise or counterclockwise, the front wheel 2 is turned to a desired direction.

The vehicle body frame of the motorcycle 1 is of a twin tube type. A pair of right and left main frames 7 (only left main frame 7 is illustrated in FIG. 1) extend rearward from the head pipe 6. Pivot frames (swing arm brackets) 8 extend downward from rear regions of the main frames 7. A swing arm 10 is pivotally mounted at a front end portion thereof to a pivot 9 attached on the pivot frame 8. The rear wheel 3 is rotatably mounted to a rear end portion of the swing arm 10.

A fuel tank 12 is disposed above the main frames 7 and behind the steering handle 4. A straddle-type seat 13 is disposed behind the fuel tank 12. A fuel injection engine (hereinafter simply referred to as an engine) E is mounted between and under the right and left main frames 7. The engine E is covered with a cowling 15 from the side. The engine E is an inline four-cylinder four-cycle engine, and is constructed in such a manner that a crankshaft 35 extends in the lateral direction of the vehicle body. An output of the engine E is transmitted, through a chain 14, to the rear wheel 3, which thereby rotates. In this manner, the motorcycle 1 obtains a driving force.

The engine E includes an oil pan 20, a crankcase 21, a cylinder block 22, a cylinder head 23, and a cylinder head cover 24 arranged in this order from below. A cylinder 25 composed of the cylinder block 22, the cylinder head 23, and the cylinder head cover 24 is tilted forward with respect to a vertical direction of the vehicle body of the motorcycle 1. An air inlet 16A through which air is taken in from outside is formed on a front cowling 16 at the front portion of the vehicle body. An air-intake duct 17 extends rearward from the air inlet 16A. A downstream end portion of the air-intake duct 17 in an air flow direction is coupled to an air cleaner box 18 at a location below the fuel tank 12. An air-intake pipe 19 extends downward from the air cleaner box 18, and a downstream end portion thereof is coupled to an intake port 30 formed at a rear portion of the cylinder head 23. A throttle body 60 (see FIG. 3) is disposed between the air cleaner box 18 and the air-intake pipe 19. A fuel injector 61 (see FIG. 3) is attached to a location of a rear wall portion of the air-intake pipe 19 and is configured to inject fuel to be mixed with the air flowing in the air-intake pipe 19. An exhaust pipe 32 is coupled to an exhaust port 31 and extends from a front portion of the cylinder head 23. The exhaust pipe 32 is coupled to a muffler (not shown) located behind through a region below the crankcase 21.

Figure 2:
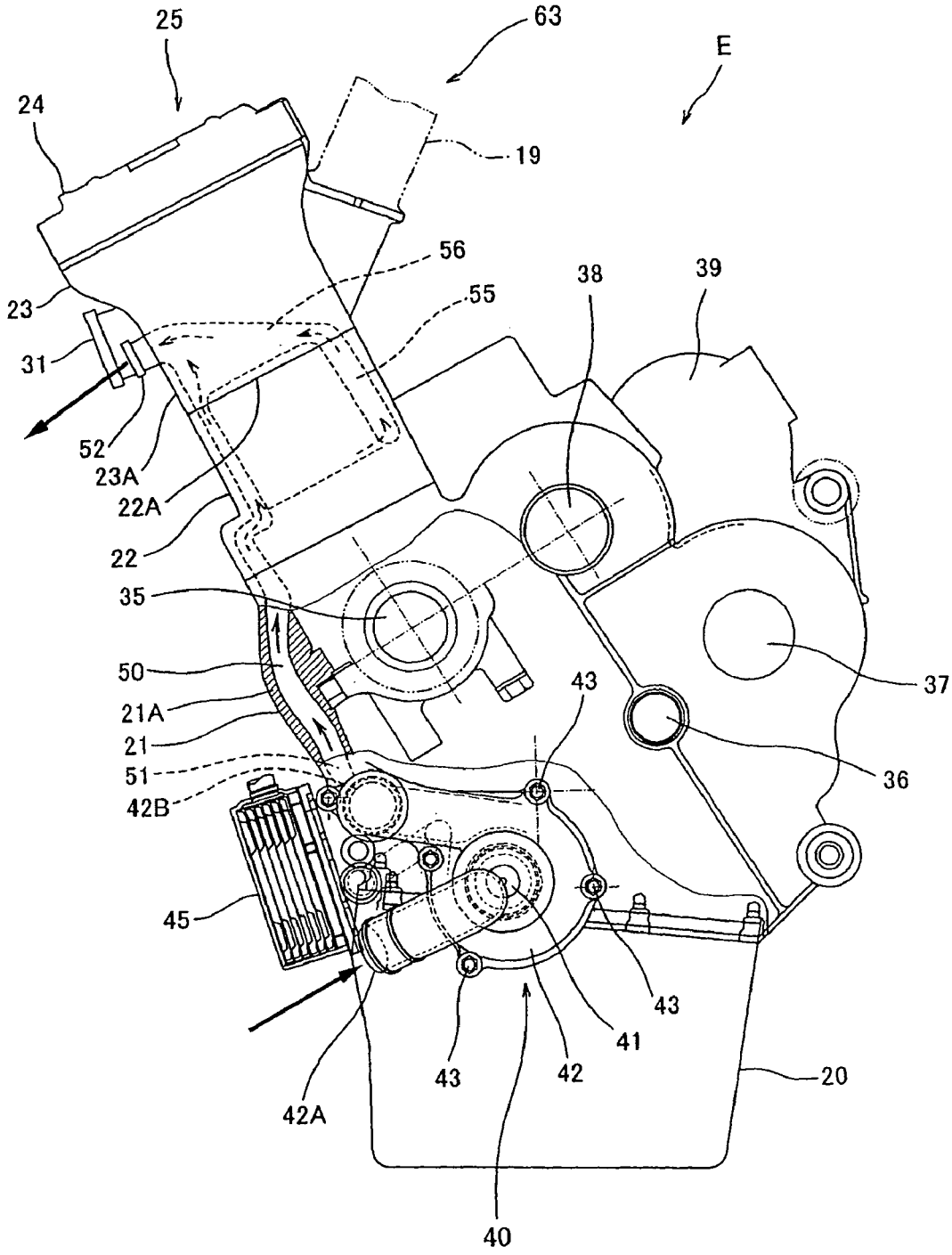
FIG. 2 is a left side view of the engine of FIG. 1, showing a structure of a cooling water passage formed in a cylinder.

FIG. 2 is a left side view of the engine E, showing in large part a structure of a cooling water passage through which cooling water is delivered to the cylinder 25. As shown in FIG. 2, in the engine E, a rotational speed of the crankshaft 35 is transmitted to a main shaft 36 and a countershaft 37 of a transmission, which changes the rotational speed, and the resulting rotational speed is output from the countershaft 37 to a chain 14 of FIG. 1. A balancer shaft 38 is disposed behind and above the crankshaft 35 in the interior of the crankcase 21 and is configured to rotate in association with the crankshaft 35. A generator 39 is disposed behind the balancer shaft 38.

A water pump 40 is mounted to a lower portion of the crankcase 21 below the crankshaft 35. The water pump 40 operates in association with the crankshaft 35 together with an oil pump (not shown) to supply the cooling water from a radiator 46 of FIG. 1 to the cylinder 25 through a cooling water passage 50. The oil pump is configured to feed oil suitably cooled by an oil cooler 45 mounted to a front portion of the crankcase 21 to suitably lubricate and cool engine components.

The water pump 40 and the cooling water passage 50 will be described in detail. The water pump 40 is disposed in such a manner that a pump shaft 41 extends substantially in parallel with the crankshaft 35. The water pump 40 covered laterally with a pump cover 42 is attached to the crankcase 21 by a plurality of bolts 43. The pump cover 42 has a cooling water inlet 42A coupled to an outlet (not shown) of the radiator 46 (see FIG. 1) through a rubber hose or the like, and a cooling water outlet 42B from which the cooling water supplied from the radiator 46 is output. The cooling water outlet 42B is coupled to an upstream end portion 51 of the cooling water passage 50 formed in the interior of a front side wall portion 21A of the crankcase 21.

The cooling water passage 50 extends upward in the front side wall portion 21A of the crankcase 21 and then in a front side wall portion of the cylinder block 22. The cooling water passage 50 extends further upward in a front side wall portion 23A of the cylinder head 23 through a joint portion 22A at which the cylinder block 22 and the cylinder head 23 are joined to each other. A downstream end portion 52 of the cooling water passage 50 protrudes outward (forward) from the front side wall portion 23A of the cylinder head 23 at a location lateral to the exhaust port 31, and is coupled to an inlet of the radiator 46 (see FIG. 1) through, for example, a rubber hose.

The cooling water passage 50 is connected to a water jacket 55 formed in the cylinder block 22 and to a water jacket 56 formed in the cylinder head 23. The water jacket 55 is formed to extend over an entire circumference of an upper portion of the cylinder block 22 in a direction in which the cylinder 25 extends. The cooling water flowing from the cooling water passage 50 is supplied to the water jacket 55. The water jacket 56 is formed in the wall portion of the cylinder head 23 as described fully later. The water jackets 55 and 56 are connected to each other through the joint portion 22A between the cylinder block 22 and the cylinder head 23. The cooling water flowing from the cooling water passage 50 is supplied to the water jacket 56 in the cylinder head 23 through the water jacket 55 and the joint portion 22A.

In the engine E constructed above, the cooling water that has been cooled by the radiator 46 is supplied with a pressure by the water pump 40 driven by the engine E to the upstream end portion 51 of the cooling water passage 50. As indicated by arrows of FIG. 2, the cooling water flows upward in the front side wall portion 21A of the crankcase 21 and then in the water jackets 55 and 56 respectively formed in the cylinder block 22 and the cylinder head 23. After suitably cooling the portions of the cylinder block 22 and the cylinder head 23, the cooling water is returned to the radiator 46 through the downstream end portion 52 protruding from the front portion of the cylinder head 23. The cooling water radiates heat in the radiator 46.

Figure 3:
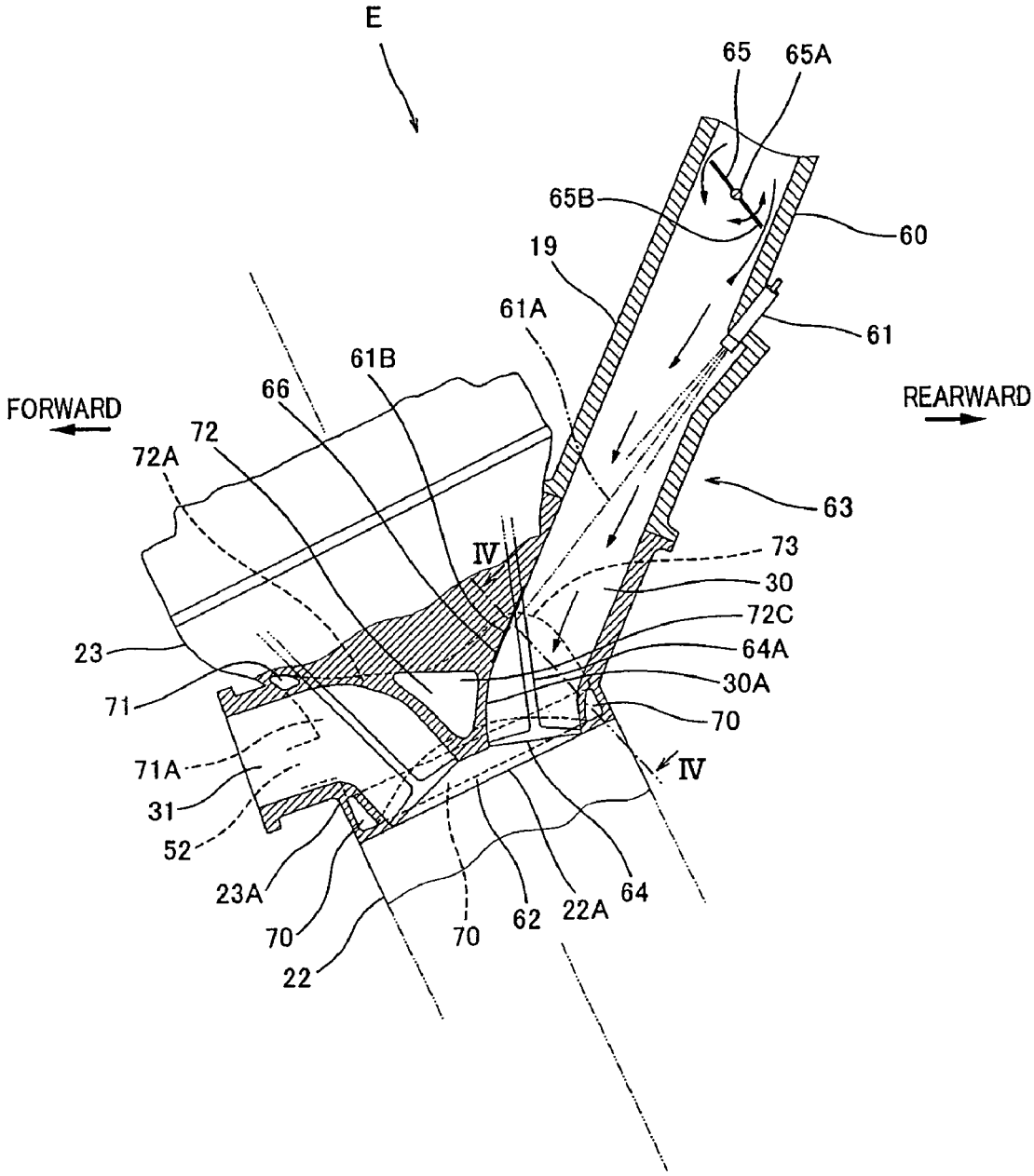
FIG. 3 is an enlarged partial cross-sectional view schematically showing a region surrounding a cylinder head and an air-intake pipe connected to the cylinder head.

FIG. 3 is an enlarged partial cross-sectional view schematically showing a region surrounding the cylinder head 23 and the air-intake pipe 19 coupled to the cylinder head 23. FIG. 3 illustrates a cross-section formed by sectioning one of four cylinders along a vertical plane including a fuel injection center line 61A of fuel injected from the corresponding fuel injector 61.

As shown in FIG. 3, the combustion chamber 62 is surrounded by the cylinder block 22 and the cylinder head 23, and the intake port 30 extends from the combustion chamber 62 to a rear portion of the cylinder head 23. The intake port 30 extends upward and slightly rearward to form a curved portion 30A in the interior of the cylinder head 23. An upstream end portion of the intake port 30 protruding from a rear portion of the cylinder head 23 is coupled to a downstream end portion of the air-intake pipe 19. The air-intake pipe 19 and the intake port 30 form an air-intake passage 63 extending from the air cleaner box 18 (see FIG. 1) to the combustion chamber 62. An intake valve 64 is mounted in such a manner that a valve stem 64A penetrates through a region of an inner wall of the intake port 30 that is located upstream of the curved portion 30A.

The air-intake pipe 19 extends substantially upward from an upstream end portion of the intake port 30. An upstream end portion of the air-intake pipe 19 is coupled to the air cleaner box 18 through a throttle body 60 in which the butterfly valve 65 is internally provided. The butterfly valve 65 of the throttle body 60 is attached to a rotational shaft 65A extending in the lateral direction. The rotational shaft 65A is coupled to a throttle grip (not shown) provided on the right side of the steering handle 4 (see FIG. 1) via a wire. Upon the rider rotating the throttle grip to open the butterfly valve 65, a lower portion 65B of the butterfly valve 65 is pivoted in the air flow direction, thereby forming a gap between the butterfly valve 65 and an inner wall of the air-intake pipe 19, through which the air is supplied from the cleaner box 18 toward the combustion chamber 62. In other words, the butterfly valve 65 opens the air-intake passage 63 in such a manner that the lower portion 65B which is located closer to the fuel injector 61 attached to the rear wall portion of the air-intake pipe 19 than the rotational shaft 65A is pivoted downward in the air flow direction.

The fuel injector 61 is mounted at a location of the air-intake pipe 19 in close proximity to the upstream end portion thereof coupled to the throttle body 60. The fuel injector 61 injects the fuel in a mist flow at a predetermined time according to an electric signal sent from a controller (not shown). The fuel injection center line 61A of the injected fuel extends from the fuel injector 61 and crosses at a point 61B of the inner wall of the intake port 30 that is located slightly upstream of the curved portion 30A and slightly downstream of the region where the valve stem 64A penetrates. Therefore, some of the fuel injected is directly delivered to the combustion chamber 62 together with the air, and the remaining fuel collides against and adheres to the point 61B and a region near the point 61B on the inner wall of the intake port 30, which are collectively called hereinbelow a fuel adhering region 66. The fuel adhering region 66 is indicated by a bold line in FIG. 3 and is hatched in FIG. 4.

Figure 4:
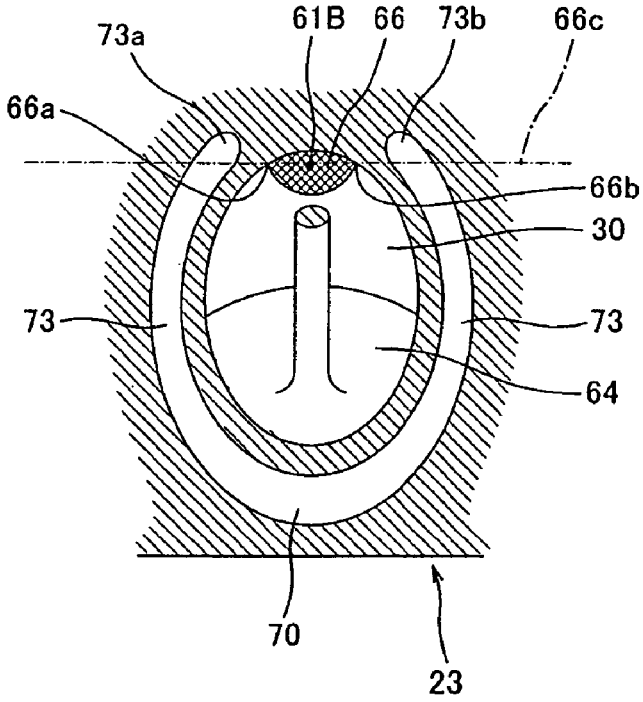
FIG. 4 is a partial cross-sectional view taken along line IV-IV of the cylinder head of FIG. 3.

With reference to FIGS. 3 and 4, the structure of the water jacket 56 formed in the cylinder head 23 will be described in detail. FIG. 4 is a partial cross-sectional view taken along line IV-IV of the cylinder head 23 of FIG. 3, illustrating a cross-section of the cylinder head 23, which passes through the fuel adhering region 66 and crosses in the air flow direction. As shown in FIG. 3, in this embodiment, the water jacket 56 is mainly composed of four water jackets 70 to 73. To be specific, the water jacket 70 is formed to extend over an entire circumference of a lower portion of the cylinder head 23 to surround the lower portion, and the cooling water flowing in the water jacket 70 cools the wall portion around the combustion chamber 62. The water jacket 70 is connected to the water jacket 55 (see FIG. 2) formed in the cylinder block 22 through the joint portion 22A between the cylinder block 22 and the cylinder head 23.

The water jacket 71 is formed to extend over an entire circumference of the exhaust port 31 to surround the exhaust port 31. The water jacket 71 is connected to the water jacket 70 formed in the lower portion of the cylinder head 23 together with a water jacket portion 71A (see broken line of FIG. 3) around the exhaust port 31. The water jacket 71 around the exhaust port 31 is connected to the downstream end portion 52 of the cooling water passage 50 protruding forward from the front side wall portion 23A of the cylinder head 23.

The water jacket 72 is formed at a substantially center position of the cylinder head 23 in the longitudinal direction of the motorcycle 1. The cooling water flowing in the water jacket 72 cools a region around an upstream end portion of the exhaust port 31, a region around an ignition device (not shown) of the engine E, and a region around a downstream end portion of the intake port 30. The water jacket 72 is connected to the water jacket 71 surrounding the exhaust port 31 through the water jacket portion 72A (see broken line of FIG. 3) surrounding the exhaust port 31. As described later in detail, the water jacket 73 (see broken line of FIG. 3) is formed to surround the intake port 30, and the water jacket 72 located at the substantially center position is connected to the water jacket 70 formed in the lower portion of the cylinder head 23 through the water jacket 73.

As shown in FIG. 3, an upper end portion 72C (indicated by a solid line) of the water jacket 72 is disposed below the fuel adhering region 66. Therefore, cooling of the fuel adhering region 66 of the intake port 30 by the cooling water flowing in the water jacket 72 is suppressed. The entire upper end portion of the water jacket 72 is not necessarily disposed below the fuel adhering region 66, but a part of the upper end portion of the water jacket 72 that is located in close proximity to the air-intake passage 63 is required to be located below the fuel adhering region 66 in order to suppress cooling of the fuel adhering region 66.

As shown in FIG. 4, the water jackets 70 and 73 surround a region near the downstream end portion of the intake port 30 except for the fuel adhering region 66 so that these jackets 70 and 73 are not located directly behind the fuel adhering region 66.

As shown in FIG. 4, as viewed in a plane (see plane taken along line IV-IV of FIG. 3) passing through the fuel adhering region 66 and crossing in the air flow direction, the water jacket 73 extends in the circumferential direction of the air-intake passage 30 so as to surround the air-intake passage 30. A left end portion 73*a* of the water jacket 73 is located near one lateral end position 66*a* of the fuel adhering region 66 and a right end portion 73*b* thereof is located laterally near an opposite lateral end position 66*b* of the fuel adhering region 66. In this embodiment, the left end portion 73*a* and the right end portion 73*b* are located above the lateral end positions 66*a* and 66*b* of the fuel adhering region 66 such that the water jacket 73 is not located directly behind the fuel adhering region 66 as viewed from an inner surface of the intake port 30. In other words, the end portions 73*a* and 73*b* of the water jacket 73 extend upward to a region beyond a line 66*c* (indicated by dotted line in FIG. 4) connecting the lateral end positions 66*a* and 66*b* of the fuel adhering region 66. This makes it possible to inhibit the fuel adhering region 66 from being cooled while effectively cooling the air by using the cooling water flowing in the water jackets 70 and 73. The water jacket 56 (FIG. 2) may be disposed at other suitable regions of the air-intake port 30 as long as the water jacket 56 is not located directly behind the fuel adhering region 66. In that case, the water jacket 56 may be located upstream of the fuel adhering region 66.

In accordance with the engine E constructed above, the water jacket 56 is formed in the cylinder head 23 not to be located directly behind the fuel adhering region 66 to suppress cooling of the fuel injected from the fuel injector 61 and adhering to the inner wall of the intake port 30. The engine E having such a construction is able to suppress cooling of the fuel adhering region 66 to facilitate vaporization of the fuel adhering to the fuel adhering region 66 while effectively cooling the air flowing in the air-intake port 30. As a result, fuel efficiency is improved. The location of the fuel adhering region 66 may vary depending on the amount of air supplied to the combustion chamber 61, namely, an engine speed of the engine E. Suitably, the fuel adhering region 66 may include at least a common region to which the fuel adheres in a range from an idling state to a high engine speed state of the engine E, and the water jacket 56 may be formed not to be located directly behind the common region, for example, the water jacket 56 may extend from a lateral position of the common region.

Whereas the fuel adhering region 66 exists in the inner wall of the intake port 30, the present invention is applicable to an engine in which the fuel adhering region 66 exists in an inner wall of the air-intake pipe 19 which has a double-walled structure to form a water jacket. In that case, the water jacket of the air-intake pipe 19 is required to be formed not to be located directly behind the fuel adhering region 66 existing in the inner wall of the air-intake pipe 19.

In this embodiment, the air-intake pipe 19 connected to the intake port 30 extends upward and is coupled through the air cleaner box 18 to the air-intake duct 17 extending forward, but this construction is merely exemplary. Alternatively, the air-intake pipe 19 may be configured to extend rearward from the intake port 30, the air cleaner box 18 may be disposed behind the cylinder head 23, and the upstream end portion of the air-intake pipe 19 may be coupled to the air cleaner box 18.

Whereas the fuel injection engine E is mounted in the motorcycle 1 in this embodiment, it may alternatively be mounted in other leisure vehicles such as an all terrain vehicle or a personal watercraft (PWC).

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A fuel injection engine comprising:

an air-intake passage configured to guide air taken in from outside to a combustion chamber formed by a cylinder block and a cylinder head;

a fuel injector configured to inject fuel to an interior of the air-intake passage, wherein a part of the fuel is injected from the fuel injector along a fuel injection center line;

an exhaust passage configured to guide exhaust gases away from the combustion chamber; and a water jacket through which cooling water flows to cool the air-intake passage and the exhaust passage;

wherein an inner wall of the air-intake passage has a crossing point where the fuel injection center line and the inner wall of the air-intake passage cross each other;

wherein the inner wall of the air-intake passage has a fuel adhering region which is a predetermined region including the crossing point;

wherein as viewed in a plane crossing an air flow direction in the air-intake passage and passing through the crossing point, the water jacket is configured to be provided in a location that does not include the fuel adhering region;

wherein a portion of the water jacket positioned between the exhaust passage and the air-intake passage has a longer wall extending along the exhaust passage to cool the exhaust passage and a shorter wall extending along the air-intake passage to suppress cooling of the fuel adhering region; and wherein the water jacket extends along a circumferential direction of the air-intake passage from a region near one lateral end position of the fuel adhering region to a region near an opposite lateral end position of the fuel adhering region as viewed in the plane.

2. The fuel injection engine according to claim 1, wherein the water jacket extends to a region beyond a straight line connecting the lateral end positions of the fuel adhering region of the inner wall of the air-intake passage.

3. The fuel injection engine according to claim 1, further comprising:

a valve configured to open and close an opening of the air-intake passage that is located downstream in the air flow direction, the valve having a valve stem; wherein the crossing point is located downstream of a location where the valve stem penetrates through the inner wall of an intake port provided in the cylinder head and forming a part of the air-intake passage.

4. The fuel injection engine according to claim 1, wherein the fuel injector is attached to a wall portion of the air-intake passage, the engine further comprising:

a butterfly valve that is mounted upstream of the fuel injector in the air flow direction and is configured to be pivotable in the air flow direction to control an amount of the air flowing in the air-intake passage, the butterfly valve being configured to open the air-intake passage in such a manner that a portion of the butterfly valve that is closer to the fuel injector than a pivot shaft thereof is pivoted in the air flow direction.

5. A motorcycle comprising:

a fuel injection engine including:

an air-intake passage configured to guide air taken in from outside to a combustion chamber formed by a cylinder block and a cylinder head;

a fuel injector configured to inject fuel to an interior of the air-intake passage, wherein a part of the fuel is injected from the fuel injector along a fuel injection center line;

an exhaust passage configured to guide exhaust gases away from the combustion chamber; and a water jacket through which cooling water flows to cool the air-intake passage and the exhaust passage;

wherein an inner wall of the air-intake passage has a crossing point where the fuel injection center line and the inner wall of the air-intake passage cross each other;

wherein the inner wall of the air-intake passage has a fuel adhering region which is a predetermined region including the crossing point;

wherein as viewed in a plane crossing an air flow direction in the air-intake passage and passing through the crossing point, the water jacket is configured to be provided in a location that does not include the fuel adhering region;

wherein a portion of the water jacket positioned between the exhaust passage and the air-intake passage has a longer wall extending along the exhaust passage to cool the exhaust passage and a shorter wall extending along the air-intake passage to suppress cooling of the fuel adhering region; and wherein the water jacket extends along a circumferential direction of the air-intake passage from a region near one lateral end position of the fuel adhering region to a region near an opposite lateral end position of the fuel adhering region as viewed in the plane.

* * * * *